US005653467A

United States Patent [19]

Griffin et al.

[11] Patent Number: 5,653,467

[45] Date of Patent: Aug. 5, 1997

[54] METHOD AND APPARATUS FOR EASING THE STRAIN ON LEGS AND KNEES WHILE ON A SKI LIFT

[76] Inventors: Robert B. Griffin; Robert A. Griffin; Kathleen C. Griffin, all of 3109 Ross Rd., Palo Alto, Calif. 94303

[21] Appl. No.: 337,899

[22] Filed: Nov. 14, 1994

[51] Int. Cl.[6] ..... A63G 11/00

[52] U.S. Cl. ..... 280/809

[58] Field of Search ..... 280/809, 811, 280/812, 816, 11.36; 2/22, 311, 312, 313, 315, 309, 300, 337

[56] References Cited

U.S. PATENT DOCUMENTS

| | | | |
|---|---|---|---|
| Re. 32,650 | 4/1988 | Waddell | 2/22 |
| 4,341,400 | 7/1982 | Morgan | 280/819 |
| 4,408,600 | 10/1983 | Davis | 280/809 |
| 4,556,252 | 12/1985 | Serex | 280/809 |
| 4,582,341 | 4/1986 | Erickson | 280/824 |
| 4,759,570 | 7/1988 | Dandy, III | 280/809 |
| 4,940,255 | 7/1990 | Donine | 280/809 |
| 5,161,825 | 11/1992 | Dandy, III et al. | 280/809 |
| 5,261,699 | 11/1993 | Marston | 280/819 |

*Primary Examiner*—Anne Marie Boehler
*Assistant Examiner*—Min Yu

[57] ABSTRACT

A method and apparatus for supporting the weight of legs, boots, and skis of a skier while riding on a ski lift chair which uses a support strap (24) of elongated flexible material attached at one end to each boot in conjunction with a boot attachment strap (20). The other end of the support strap (24) extends up the back of a skier's leg to at least the back of the thigh area. The support strap (24) attaches to either a pull tab (30), a reel (42), an elastic strap (76) or an elasticized cord (50) which draws taut the support strap against the front edge of the chair seat (24) so as to slightly elevate the skier's legs, boots, and skis and support their weight. Either the weight of the thigh and buttock (34) on the support strap (24), a gear lock (46) on the reel (42), or a union between a hook tab (56) which attaches to the support strap (24) and a pile strip (58) which attaches to the ski apparel holds the support strap (24) taut and holds the supported weight of the legs, boots, and skis of a skier. Thus, the apparatus supports the legs, boots, and skis of a skier while riding on a ski lift chair and eases the strain on the skier's knees and legs.

29 Claims, 3 Drawing Sheets

METHOD AND APPARATUS FOR EASING THE STRAIN ON LEGS AND KNEES WHILE ON A SKI LIFT

BACKGROUND—FIELD OF INVENTION

This invention is in the general field of skiing and specifically relates to methods and apparatus for supporting the weight of legs, boots, and skis of a skier while riding on a ski lift chair.

BACKGROUND—DESCRIPTION OF PRIOR ART

Alpine or downhill skiing requires skiers to ride a lift of some kind from the base of the mountain up to a higher elevation. A common ski lift uses a chair in which skiers sit with their legs, boots, and skis hanging down unsupported below the chair. Although the combined weight of legs, boots, and skis is approximately twenty kg, most chair lifts offer no support for this weight.

Because of this lack of support, the strain placed on the knees and legs of skiers while on a ski lift is a widespread problem. Previous attempts to find a way to support the heavy weight of legs, boots, and skis while on the lift have resulted in two types of support devices, neither of which completely or satisfactorily solve the problem of creating a support apparatus which is convenient, safe, and easy to use.

One type of support device, disclosed in U.S. Pat. No. 4,582,341 to Erickson (1986) utilizes ski pole as a means of support. By attaching an arm near the handle end of the ski pole, the skier can place the arm on the seat portion of the chair and support the feet on a reinforced basket at the end of the pole. Another ski pole support is described in U.S. Pat. No. 5,261,699 to Marston (1993). Marston attaches a hook, rather than an arm, near the handle end of the ski pole. However, this support apparatus can be used only on chair lifts that are equipped with a safety bar to which the hook attaches.

A second type of support device, disclosed in U.S. Pat. No. 4,940,255 to Donine (1990), utilizes a belt which is secured around the skier's waist. Fastened to the belt is an adjustable strap with a padded bar attached perpendicularly at the end of the strap. With the strap hanging down between the skier's legs, the skis can be supported on the bar. This method stores the support apparatus in a pouch when the skier is not on the ski lift.

While providing some means of support, all prior supports had a number of disadvantages:

a. Securing the support apparatus around the waist places an uncomfortably heavy load on the skier's waist and lower back when it is in operation.

b. With these methods, the skier is required to affix, adjust, remove, or replace apparatus while on the ski lift. This is often inconvenient or difficult for the skier to do without dropping some equipment. Any skier can attest to the ease of dropping items of clothing, gloves, and poles while on a ski lift or has noticed the landscape under chair lifts littered with these items.

c. Methods and apparatus which require complicated maneuvers while on the ski lift can be unsafe. If ski poles used as part of the support apparatus are dropped, or skis slip off a basket or bar, or a hook slips off the seat, dangerous and unbalanced situations can occur.

d. With these methods, the skier must manually disengage the skis from the support apparatus before exiting the ski lift. For safety, this requires particular attention be paid at the time of lift debarkation with which both experienced and inexperienced skiers may have difficulty. The inexperienced skier, because of excitement, fear, and wonder at swinging high above the landscape, can completely miss the point at which to disengage from the support apparatus. The experienced skier, due to familiarity with the chair lift ride, can easily forget to disengage from the support apparatus at the proper time.

e. The beginning skier may find these methods too cumbersome, difficult, or hazardous to use.

f. Apparatus that must be replaced, removed, or adjusted before the skier can ski are inconvenient and difficult for a skier with bulky gloves, clothes, or gear.

g. If the apparatus is not replaced, removed, or adjusted before beginning to ski, it can become a hazard to the skier. Straps, buckles, protrusions, hooks, and the like can become tangled with the skier or other equipment, causing accident or injury.

OBJECTS AND ADVANTAGES

The present invention provides a novel method of support that overcomes the shortcomings of previous leg support devices. Besides providing support for the weight of a skier's legs, boots, and skis and skiing apparatus and easing the strain on the legs and knees, several objects and advantages of the present invention are:

a. to provide a support which attaches to the boots and apparel of the skier, distributing the weight evenly so that it is comfortable to use;

b. to provide a support which is convenient and easy to use while on a ski lift so there is no added possibility of dropping equipment;

c. to provide a method of support which allows for safety by requiring no complicated maneuvers while on a ski lift;

d. to provide a method of support which disengages automatically when the skier exits a ski lift, requiring no attention from the skier and allowing no opportunity for support members, strapping, or pole attachments to entangle with skis or the ski lift;

e. to provide a procedure of engaging the support apparatus so simple it can be accomplished by a skier of any level of competence with a single instruction;

f. to provide a support which is convenient and safe for a skier because once in place it does not need to be taken out before or put away after operation; and g. to provide a support which is primarily concealed inside or attached to the apparel of a skier so that straps, buckles, catches, and the like cannot become entangled to cause accident or injury while skiing.

Further objects and advantages of the method and support apparatus of the present invention are to provide a support which can be easily and inexpensively manufactured, which is light in weight, and which is reliable. Still further objects and advantages will become apparent from a consideration of the ensuing descriptions and drawings.

DRAWING FIGURES

REFERENCE NUMERAL IN DRAWINGS

| | | | |
|---|---|---|---|
| 18 | support appartus | 18a | support appartus |
| 18b | support apparatus | 18c | support apparatus |
| 18d | support apparatus | 18e | support apparatus |
| 18f | support apparatus | 18g | support apparatus |
| 20 | boot attachment strap | 21 | boot |
| 22 | closure | 23 | first end portion |
| 24 | support strap | 24a | support strap |
| 24b | support strap | 24c | support strap |
| 24d | support strap | 24e | support strap |
| 24f | support strap | 24g | support strap |
| 26 | side pocket | 28 | tube |
| 28a | tube | 29 | second end portion |
| 29a | second end portion | 29b | second end portion |
| 29c | second end portion | 30 | pull tab |
| 32 | suit | 34 | thigh and buttock |
| 35 | chair lift seat | 36 | point |
| 37 | waist eyelet | 38 | D-ring |
| 39 | loop | 40 | middle back of waist |
| 41 | front side of waist | 42 | reel |
| 42a | reel | 44 | frictional strap |
| 44a | frictional strap | 44b | frictional strap |
| 46 | gear lock | 47 | back of waist |
| 48 | comfort strap | 48a | comfort strap |
| 50 | elastisized cord | 51 | point |
| 52 | cord guide | 56 | pile strip |
| 56a | pile strip | 56b | pile strip |
| 58 | hook tab | 58a | hook tab |
| 58b | hook tab | 60 | exterior ribbon |
| 62 | point | 66 | first eyelet |
| 68 | second eyelet | 72 | fastener |
| 76 | elastic strap | 80 | flap |
| 82 | post and cap attachment | 84 | strap adjuster |

SUMMARY

The method and apparatus of support of the present invention ease the strain on skier's knees while in a chair lift. It consists of five main elements. These five elements comprise a unique method of support for the legs, boots, and skis of a skier while riding in a chair lift and are present in all its ramifications and embodiments. They are (a) a boot attachment suitable for fastening to each ski boot, (b) support straps to support the weight of the legs, boots, and skis, (c) a way or tensioning the support straps so the support straps are drawn taut in order to provide support for the legs, boots, and skis, (d) locking means to anchor and hold taut the support straps so that the legs, boots, and skis are supported, and (d) a way to fasten the support apparatus to the leg of the skier. These five elements will be detailed in the following description and accompanying drawings of the preferred embodiment and in the descriptions and accompanying drawings of all other embodiments.

DESCRIPTION OF PREFERRED EMBODIMENT—FIGS. 1–3

Figure 1:
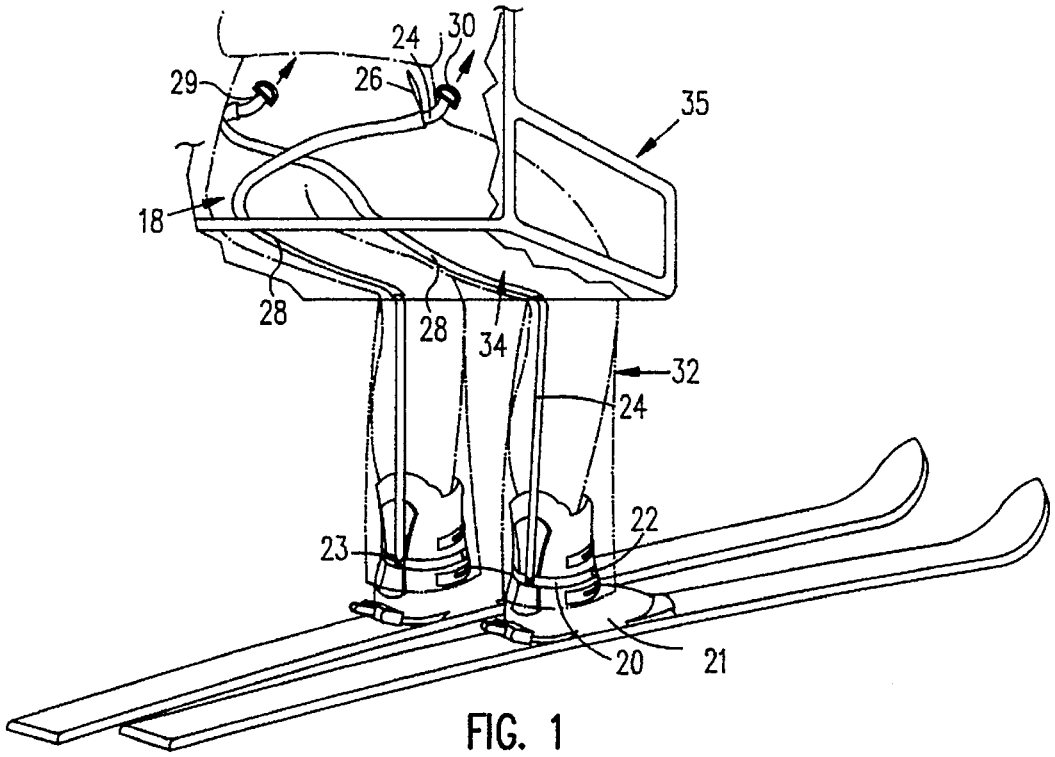
FIG. 1 is a perspective of a skier sitting on a ski lift chair showing the preferred embodiment of a support apparatus according to the invention in use.

A preferred embodiment of the method and apparatus of the present invention is illustrated in FIG. 1 which shows a skier in a chair lift using the method and apparatus. A support apparatus 18 holds the combined weight of legs, boots and skis of a skier so as to ease the strain on the knees and legs.

Figure 2:
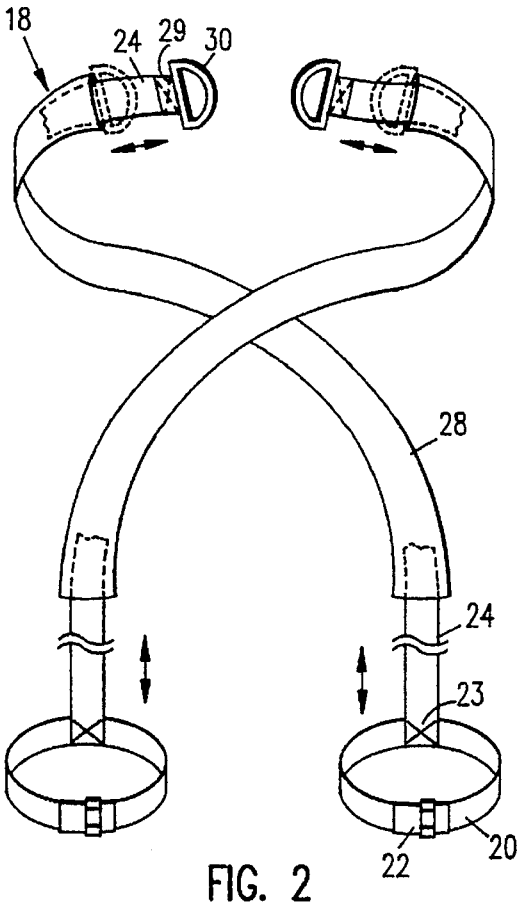
FIG. 2 is a perspective view of the preferred embodiment of the support apparatus.

FIGS. 1 and 2 show all the essential elements of the support apparatus. A boot attachment strap 20 is fastened to each boot 21 by encircling the ankle part of boot 21 and attaching to itself with a closure 22. The closure consists of a plastic quick-release clasp. However, the closure can be any other type of common closure, such as a hook-and-pile closure, a buckle, a spring snap, or other kinds of clasps. A support strap 24, strong enough to support the weight of legs, boots, and skis of a skier, is fastened and held in place by being sewn, riveted, clamped or the like at a first end portion 23 to boot attachment strap 20. The material used for the support strap is a two-cm, flat, nylon webbing, but other materials, such as ribbon, cord, line, or laces, either natural or synthetic, of sufficient strength can be used.

From boot attachment strap 20, support strap 24 extends up the back of the inside of each of the legs of a ski suit 32 and through a flat tube 28 made of flexible material which is large enough to allow support strap 24 to freely slide within. The tube consists of flat, tubular webbing 2.5 cm in width, but other materials which allow the free movement of the enclosed support strap can be used, As shown, tube 28 is sewn or otherwise fastened to the back inside of the pants of suit 32, beginning at the back of each knee, extending up the back of each thigh, crisscrossing at the buttocks and terminating, still attached, in the vicinity of a, side pocket 26 where it opens to the outside of suit 32.

The terminating point for the tube and the support strap can be another area of the suit, depending upon the style of the suit or other considerations. Accordingly, the tube and the support strap exit the ski suit at the waist, in the area of the back pockets, or at the front of the suspenders on a bib-type suit.

In the manner known to those skilled in the art, a cord grip or a pull tab 30 is fastened to a second end portion 29 of support strap 24, which extends out of tube 28 slightly. In the preferred embodiment, the pull tab consists of a ring. However, the pull tab can also be any attachment which prevents the support strap from slipping down inside the tube and which assists in grasping and pulling the support strap.

OPERATION OF PREFERRED EMBODIMENT—FIGS. 1 & 3

Figure 3:
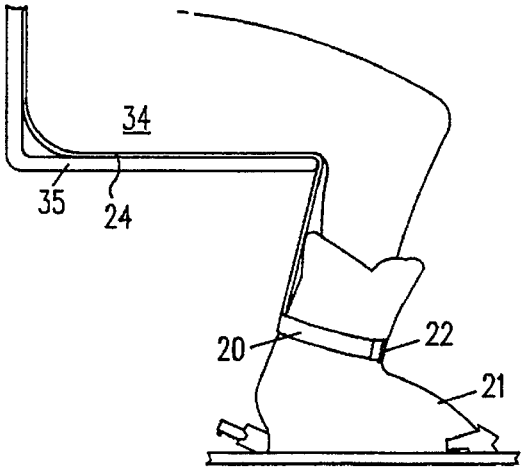
FIG. 3 is a side view of a skier sitting on a ski lift chair showing a support strap after it has been drawn taut and is supporting the legs, boots, and skis of the skier.

The operation of the support apparatus is best illustrated by reference to FIGS. 1 & 3. To engage support apparatus 18 and cause it to help carry the heavy load which bears on the knees from the weight of the legs, boots, and skis, the skier lifts the thigh and buttock 34 on one side of the body until their weight is slightly touching, but not bearing on, a chair lift seat 35. On the opposite side of the body from that which is raised, the skier pulls on pull tab 30. When tab 30 is pulled, support strap 24 slides up through tube 28, which acts as a channel or sheath for support strap 24, keeping support strap 24 in the correct position beneath thigh and buttock 34. Support strap 24 is drawn taut as it is pulled up and pressed against the front edge of chair lift seat 35 as shown in FIG. 3.

The skier then replaces thigh and buttock 34 on chair lift seat 35 trapping support strap 24 and tube 28 between thigh and buttock 34 and the seat of chair lift seat 35, thus creating a good frictional engagement. The weight of thigh and buttock 34 on support strap 24, together with the frictional qualities of the tube and the support strap, act as a friction locking means to lock support strap 24 in place. FIG. 3 shows support strap 24 after it has been drawn taut and is being held in place underneath thigh and buttock 34. The same procedure is used to lift and support the second leg, boot, and ski. Support strap 24 is now supporting the weight of the legs, boots, and skis of the skier, allowing the skier to ride up the mountain with less discomfort to the knees and legs.

When exiting the chair lift, the skier disembarks in the usual manner. As the skier stands to ski off the lift and removes the weight of thigh and buttock 34 from support strap 24 and tube 28, support strap 24 slips back through tube 28. Thus, the support apparatus disengages automatically.

DESCRIPTION OF LOCK AT WAIST VERSION—FIG. 4

Figure 4:
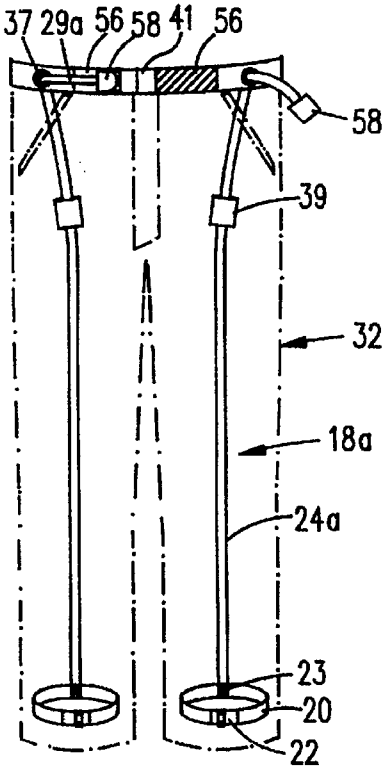
FIG. 4 shows a front view of ski pants with a support apparatus attached inside the pants at the back and with the support apparatus utilizing a locking device at the waist.

A second embodiment of the support apparatus is illustrated in FIG. 4 which shows a front view of suit 32 with a support apparatus 18*a* attached to the inside of the back of the pants. This embodiment utilizes a secondary locking device at the waist to hold the support strap taut.

From boot attachment strap 20, a support strap 24*a*, made of a cord material in this embodiment because it is less bulky, extends up the back of each leg inside suit 32, and continues up the same leg to and through a waist eyelet 37 to the outside of suit 32. Waist eyelet 37 is fastened through approximately at the front side of waist 41, as best shown in FIG. 4. Directly in front of waist eyelet 37, a pile strip 56, approximately ten cm in length, is fastened on the waistband, as shown in FIG. 4. A hook tab 58 is fastened to a second end portion 29*a* of support strap 24*a*. The hook tab and pile strip serve as a secondary locking device.

In this embodiment there is no tube to attach to the suit, although a tube can be used if a more secure attachment to the suit is desired. Instead, a loop 39 is fastened to the back of the pants inside the suit and is also fastened around support strap 24*a* at approximately the buttock area so as to keep support strap 24*a* in the correct position underneath the thigh and buttock.

By using a cord material for the support strap and omitting the tube, this embodiment is less bulky and easier to use inside form-fitting ski apparel.

OPERATION OF LOCK AT WAIST VERSION—FIGS 3 & 4

The operation of the second embodiment may be best illustrated by reference to FIGS. 3 and 4. To engage this embodiment the skier, while sitting on chair lift 35 lifts one thigh and buttock 34. On the same side that is raised, the skier manually pulls on and attaches hook tab 58 to pile strip 56. By this action, support strap 24*a* is pulled up and drawn taut against the front edge of chair lift seat 35 as shown in FIG. 3.

The skier then replaces thigh and buttock 34 on chair lift seat 35. The frictional engagement caused by the weight of thigh and buttock 34 on support strap 24*a*, together with the union between hook tab 58 and pile strip 56 at the waist, lock and hold taut support strap 24*a* which then supports the weight of the leg, boot, and skis (FIG. 3). When the skier stands up to exit the chair lift, hook tab 58 and pile strip 56 pull apart, thus disengaging the support apparatus automatically.

DESCRIPTION OF REEL VERSION—FIG. 5

Figure 5:
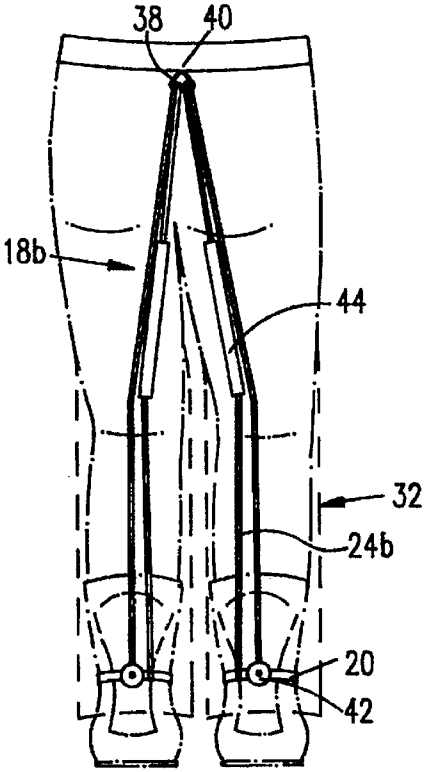
FIG. 5 shows a rear view of a skier with a support apparatus attached to the back of the inside of the ski pants and with the support apparatus utilizing a reel to retract the support strap.

FIG. 5 shows a third embodiment of a support apparatus 18*b* which utilizes a reel to retract the support strap. One end of a support strap 24*b* is fastened to boot attachment 20. The other end of support strap 24*b* extends up the back of each leg inside suit 32 and through a D-ring 38 which is sewn or otherwise fastened to a point at a middle back of waist 40. Support strap 24*b* continues its path down the back of the same leg where it is fastened to and around a conventional spring-loaded reel 42 which keeps the support strap under slight constant tension. A cord or line material is used in this embodiment for the support strap so that it can easily wind on a reel. Reel 42 attaches to boot attachment 20 in the approximate position as best shown in FIG. 5.

At the back of the thigh, approximately as shown in FIG. 5, a frictional strap 44, about 15 to 25 cm in length, is sewn or otherwise fastened to support strap 24*b* to become an integral part of the support strap.

OPERATION OF REEL VERSION—FIGS 3 & 5

The operation of the third embodiment may be best illustrated by reference to FIGS. 3 and 5. To engage this embodiment, the skier, while sitting on chair lift 35, raises thigh and buttock 34 on one side of the body allowing reel 42 to retract support strap 24*b*. This action causes support strap 24*b* to be drawn taut against the front edge of chair lift seat 35 as shown in FIG. 3 and thereby slightly elevates the legs, boots, and skis of the skier. By the retraction of support strap 24*b*, frictional strap 44 is positioned under the upper thigh and buttock area.

The skier then replaces thigh and buttock 34 on chair lift seat 35, trapping frictional strap 44 between thigh and buttock 34 and chair lift seat 35. The weight of thigh and buttock 34, together with the frictional qualities of strap 44, anchor and lock in place support strap 24*b* which then carries the weight of the skier's legs, boots, and skis (FIG. 3). When the skier stands up, removing the weight from frictional strap 44, support strap 24*b* unwinds from reel 42, lengthens, and the support apparatus disengages automatically.

DESCRIPTION OF REEL WITH LOCK VERSION—FIG. 6

Figure 6:
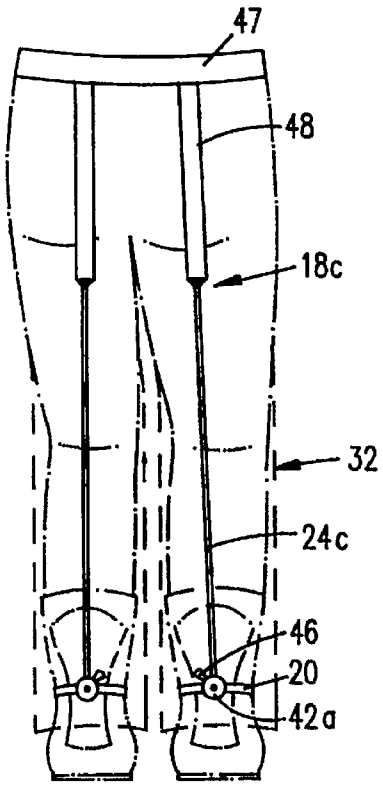
FIG. 6 shows a rear view of a skier with a support apparatus attached to the back of the inside of the ski pants and with the support apparatus utilizing a gear lock as a locking device.

FIG. 6 illustrates a fourth embodiment of the support apparatus. A support apparatus 18*c* adds a lock to the reel version which locks the support strap in place.

A spring-loaded reel 42*a* with a gear lock 46 is fastened to boot attachment 20. A support strap 24*c* is fastened to and around reel 42*a* in such a manner as to allow it to wind and unwind. A cord or line material is used for the support strap in this embodiment also so that it can wind easily on the reel. Support strap 24*c* extends up the back of the skier's leg on the inside of suit 32 approximately to the back or the buttock area, connecting at that point in a standard way to a comfort strap 48 which continues a path straight up the backside of the buttock. Comfort strap 48 is an integral part of support strap 24*c* but is made of a flatter and wider material to prevent discomfort when the support apparatus is engaged. Comfort strap 48 fastens in a standard way to a point at a back of waist 47 of the skier's suit.

OPERATION OF REEL WITH LOCK VERSION—FIGS 3 & 6

The operation of the fourth embodiment may be best illustrated by reference to FIGS. 3 and 6. To engage this embodiment, the skier, while sitting on chair lift seat 35, slightly raises thigh and buttock 34 which allows reel 42*a* to retract support strap 24*c*. Support strap 24*c* is drawn against the front edge of chair lift seat 35 as shown in FIG. 3. The skier then manually depresses gear lock 46, on the side of the body which is lifted, to anchor and lock in place support strap 24*c* which then carries the weight of the skier's legs, boots, and skis (FIG. 3). To disengage the support apparatus, the skier, by lifting the knees, removes the tension from and unlocks reel 42*a*. Support strap 24*c* unwinds From reel 42*a*, lengthens, and the support apparatus disengages.

DESCRIPTION OF ELASTICIZED CORD VERSION—FIG. 7

Figure 7:
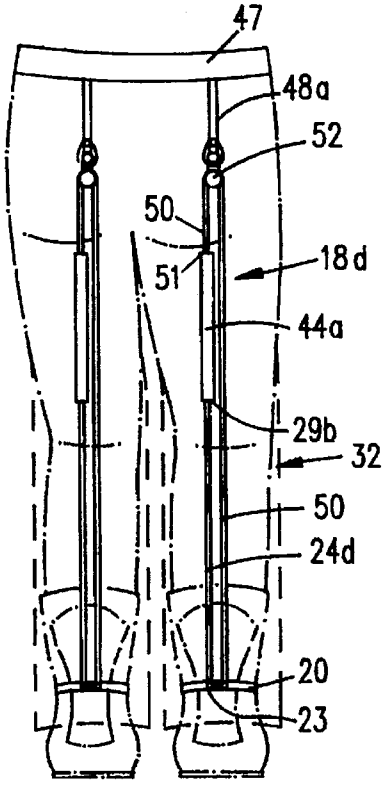
FIG. 7 shows a rear view of a skier with a support apparatus attached inside the ski pants at the back and with the support apparatus utilizing an elasticized cord to draw taut the support strap.

FIG. 7 shows a fifth embodiment of the support apparatus. A support apparatus 18*d* uses an elasticized cord to draw taut the support strap. A comfort strap 48*a* is attached inside of suit 32 at back of waist 47 in a standard way and extends down to approximately the top of the buttock area as shown in FIG. 7. At this point, a roller-type cord guide 52 is attached to comfort strap 48*a*.

Support strap 24*d* is fastened to boot attachment 20 and extends up the back of the inside of each pant leg of suit 32. At approximately the thigh area at a second end portion 29*b*, frictional strap 44*a* is attached to and becomes an integral part of support strap 24*d*. At a point 51, at the end of frictional strap 44*a*, an elasticized cord 50 is sewn or otherwise fastened to also become an integral part of support strap 24*d*. Cord 50 extends up and through cord guide 52 and continues a path back down the back of the leg to where it is sewn or otherwise attached to boot attachment 20. In this embodiment, because an elastisized cord is being used to draw taut the support strap, the support apparatus must be set by pulling a slight tension into the support strap and the elastisized cord. The whole support apparatus must remain very slightly taut at all times for the apparatus to function well.

OPERATION OF ELASTICIZED CORD VERSION—FIGS. 3 & 7

The operation of the fifth embodiment may be best illustrated by reference to FIGS. 3 and 7. To engage this embodiment, the skier, while sitting on chair lift seat 35, slightly raises thigh and buttock 34 allowing elasticized cord 50 (FIG. 7) to retract and draw taut support strap 24*d* against the front edge of chair lift seat 35 as shown in FIG. 3. This action also positions frictional strap 44*a* underneath thigh and buttock 34 and slightly elevates the legs, boots, and skis of the skier.

The skier then replaces thigh and buttock 34 on chair lift 35. Frictional strap 44*a* is trapped between thigh and buttock 34 and chair lift seat 35 so that support strap 24*d* is held taut and locked in place in order to carry the weight of the skier's legs, boot, and skis (FIG. 3). When the skier stands up, taking the weight off of frictional strap 44*a*, the apparatus disengages automatically.

DESCRIPTION OF EXTERIOR STRAP VERSION—FIG. 8

Figure 8:
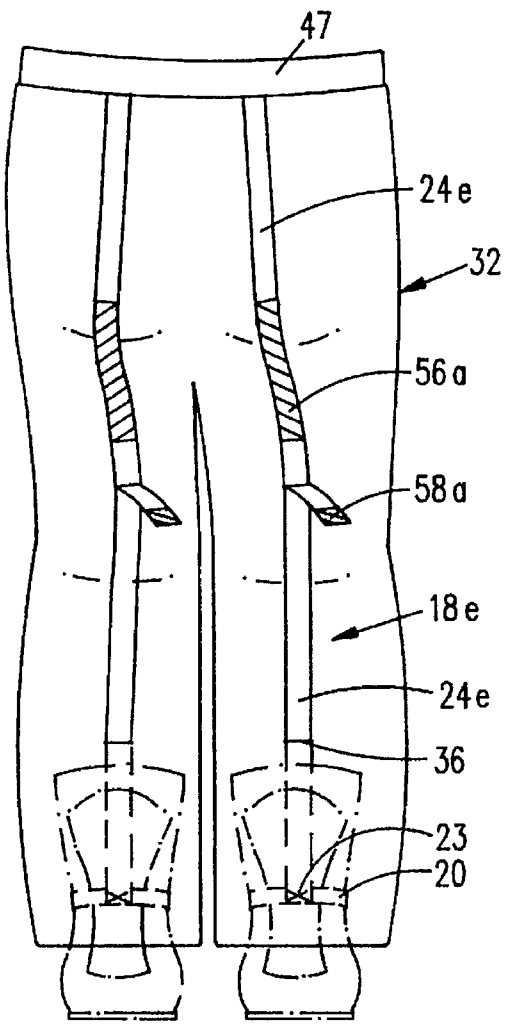
FIG. 8 shows a rear view of a skier using a support apparatus which attaches the support strap to the exterior of the back of the ski pants.

FIG. 3 illustrates a sixth embodiment of the support apparatus. A support apparatus 18*e* differs in that it is attached to the outside of suit 32. First end portion 23 of a support strap 24*e* is fastened to boot attachment 20 in a standard way. From first end portion 23, support strap 24*e* extends up the inside of the back of the pant leg to a point 36, approximately at the boot top as shown in FIG. 8, where it exits the pants. From point 36, the length of support strap 24*e* is sewn or otherwise fastened to the outside of the back of each pant leg of suit 32, extending up to back of waist 47.

A pile strip 56*a* is affixed to support strap 24*e* from the thigh area of the pants up to the buttock area as shown best in FIG. 8. One end of a hook tab 58*a* approximately six cm in length is sewn or otherwise fastened to support strap 24*e* at a point below pile strip 56*a*.

OPERATION OF EXTERIOR STRAP VERSION—FIGS. 3 & 8

The operation of the sixth embodiment may be best illustrated by reference to FIGS. 3 and 8. To engage this embodiment, the skier, while sitting on chair lift seat 35, lifts thigh and buttock 34, grasping and pulling hook tab 58*a* toward the buttock. Support strap 24*e* is thereby drawn taut against the front edge chair lift seat 35 as shown in FIG. 3.

After manually attaching hook tab 58*a* to pile strip 56*a*, the skier replaces thigh and buttock 34 on chair lift seat 35, trapping hook tab 58*a* and pile patch 56*a* between thigh and buttock 34 and chair lift seat 35 (FIG. 3). The weight of thigh and buttock 34, together with the support of the union between hook tab 58*a* and pile strip 56*a*, lock and hold support strap 24*e* taut which then carries the weight of the skier's legs, boots, and skis (FIG. 3). When the skier stands up to exit the ski lift and extends the leg from its bent position, the union of hook tab 58*a* and pile strip 56*a* disengages automatically.

Because the pants are folded up with the support strap in this embodiment, it is desirable for the support strap to be at least two cm wide and firmly attached to the apparel. This embodiment works best with ski apparel which is worn large and baggy, such as that used by snowboarders, so there is enough pant material to pull easily with the strap.

DESCRIPTION OF EXTERIOR RIBBON WITH EYELETS VERSION—FIG. 9

Figure 9:
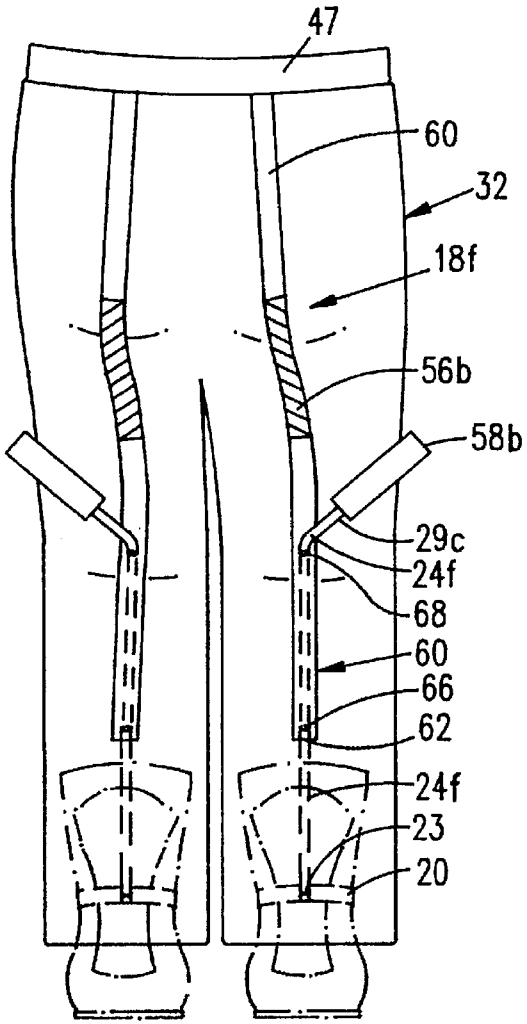
FIG. 9 shows a rear view of a skier using a support apparatus which attaches an exterior ribbon with eyelets to the back of the exterior of the ski pants to be used as a channel for the support strap.

A seventh embodiment of the support apparatus is illustrated in FIG. 9. A support apparatus 18*f* utilizes an exterior ribbon as a channel for the support strap. An exterior ribbon 60 is sewn or otherwise fastened to the back side of the pant leg on the outside of suit 32 from a point 62 up to back of waist 47. Pile strip 56*b* is affixed to exterior ribbon 60 from the thigh area of the pant up to approximately the buttock.

At approximately above point 62, a first eyelet 66 is fastened through the backside of the pant and a second eyelet 68 is fastened through ribbon 60 approximately in the position above the back of the knee as shown in FIG. 9. A support strap 24*f*, made of cord material in this embodiment, is fastened at first end portion 23 to boot attachment 20 and extends up the inside of the back of the pant leg through first eyelet 66 so that it is inside exterior ribbon 60 which acts as a channel or sheath for the support strap. Support strap 24*f* continues its path up and inside exterior ribbon 60, through second eyelet 68 to the outside of exterior ribbon 60. One end of hook tab 58*b* approximately six cm in length is fastened to second end portion 29*c* of support strap 24*f*.

OPERATION OF EXTERIOR RIBBON WITH EYELETS VERSION—FIGS 3 & 9

The operation of the seventh embodiment may be best illustrated by reference to FIGS. 3 and 9. To engage this embodiment, the skier, while sitting on chair lift seat 35, lifts thigh and buttock 34. On the side of the body which is lifted, the skier then pulls up on and attaches hook tab 58*b* to pile strip 56*b*. Support strap 24*f* is pulled through exterior ribbon 60, and is drawn taut as it presses against the front edge of chair lift seat 35 as shown in FIG. 3 thereby slightly elevating the legs, boots and skis of the skier. The exterior ribbon acts as a channel for the support strap, keeping it properly situated underneath the thigh and buttock.

The skier then replaces thigh and buttock 34 back on chair lift seat 35. The weight of thigh and buttock 34, together with the union of the hook tab 58*b* and pile strip 56*b*, lock and hold taut support strap 24*f* which than supports the weight of the legs, boot, and skis of the skier (FIG. 3). The union of hook tab 58*b* and pile strip 56*b* disengages automatically when the skier stands up to exist the chair lift.

DESCRIPTION OF ELASTIC STRAP—AFTER MARKET VERSION—FIG. 10

Figure 10:
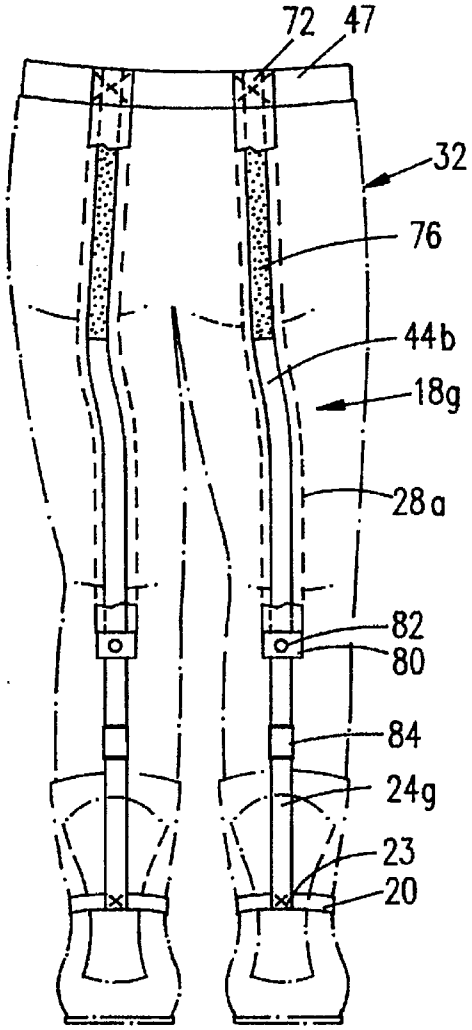
FIG. 10 shows a rear view of a skier with a support apparatus attached inside the ski pants at the back and with the support apparatus utilizing an elastic strap to draw taut the support strap.

FIG. 10 illustrates an eighth embodiment of the support apparatus. A support apparatus 18*g* can be easily attached to a ski suit by a skier without gluing, sewing, or the need for special tools. A support strap 24*g*, consisting of flat nylon webbing, is fastened at one end to boot attachment strap 20 and extends up the back of the inside of each pant leg of suit 32. Frictional strap 44*b* is fastened to support strap 24*g*, approximately as shown in FIG. 10, to become an integral part of support strap 24*g*. Elastic strap 76 attaches at one end to frictional strap 44*b* approximately as shown in FIG. 10. Support strap 24*g*, frictional strap 44*b*, and elastic strap 76, all attached end to end, extend up the back of the leg and through a tube 28*a*. Tube 28*a* is fastened once to suit 32 at the back of each knee at flap 80, as illustrated, with a sewless button or tie-tac style, post and cap attachment 82. Post and cap attachment 82 acts to keep support strap 24*g* and tube 28*a* in the correct position underneath the thigh and buttock.

Tube 28*a* extends up the back of the thigh and buttock, fastening, with any standard form of attachment to a boo a belt clip, or a fastener 72 which is hooked over the waistband at back of waist 47. The second end of elastic strap 76 is also attached to fastener 72 in the same manner. If the suit does not end at the waist with a waistband but is a bib or one piece type suit, the elastic strap and the tube can be fastened at the back of the waist of the ski apparel with any type of pin or other common fastener. Or, the skier can wear a belt inside the ski suit to which the support apparatus can be attached in a similar way. To size the support apparatus to a particular skier, a strap adjuster 84 such as those used to shorten or lengthen belts or suspenders is attached to support strap 24*g*, approximately as shown in FIG. 10.

The post and tab attachment and the belt clip used in this embodiment allow for easy attachment of the support apparatus to any ski apparel.

OPERATION OF ELASTIC STRAP—AFTER MARKET VERSION—FIGS. 3 & 10

The operation of the eighth embodiment of the support apparatus may be best illustrated by reference to FIGS. 3 and 9. To engage this embodiment, the skier while sitting on chair lift seat 35, slightly raises thigh and buttock 34. This action allows elastic strap 76 to retract and to draw taut support strap 24*g* against the front edge of chair lift seat 35 as shown in FIG. 3. This action also places frictional strap 44*b* underneath thigh and buttock 34.

Replacing thigh and buttock 34 on chair lift seat 35 traps frictional strap 44*b* so that support strap 24*g* is held taut and locked in place in order to carry the weight of the skier's legs, boots, and skis (FIG. 3). When the skier stands up to exit the ski lift, taking the weight off of frictional strap 44*b*, the apparatus disengages automatically.

SUMMARY, RAMIFICATIONS, AND SCOPE

Although differing in particulars, all of the embodiments described above use the same method of support to carry the heavy load of the legs, boots, and skis of a skier while riding on a ski lift chair. All the embodiments contain the five elements of this method or support which are (a) boot attachments, (b) support straps to support the weight of the legs, boots, and skis, (c) a way of tensioning and drawing taut the support straps, (d) locking means to hold taut the support straps so they can support the weight of the legs, boots, and skis, and (e) a way to hold the support apparatus close to the leg of the skier. Thus it can be seen that the unique method of support of this invention safely and conveniently eases the strain on the skier's knees and legs while on a chair lift. It has the additional advantages of

- disengaging automatically when the skier exits the ski lift.
- requiring no difficult maneuvers or positions for the skier while on the ski lift.
- attaching to boots and apparel so that it is in place and ready to use with no equipment to take out before or put away after operation.
- being primarily concealed inside or attached to the apparel so that it is automatically out of the way when not in use.
- being easy to engage so skiers of all ages and all levels of competence can use it.

Although the descriptions above contain many specificities, these should not be construed as limiting the scope of the invention but as merely providing illustrations of some or the presently preferred embodiments of this invention. Many or the elements of these embodiments are interchangeable and many other variations are possible.

For example, in the reel version described above, a remote control device can be used to engage and disengage the reel. The reel itself can be located in many different places, such as near the pockets or at the waist or almost any place that is easily accessible to the skier. A very narrow, flat, or low profile reel with a pressure or compression lock can be situated under the thigh which automatically engage and disengage the apparatus when the skier sits and stands. A compression lock under the thigh can serve as the locking means in most of the embodiments. This lock automatically disengages when the weight of the thigh is lifted. An air or fluid bladder or reservoir under the thigh can also be used to draw taut and/or hold the support strap.

Different boot attachments are also possible. For example, a D-ring with a clasp can be bolted or screwed to the boot shell and can be readily attached to the support strap with a hook, a line lock or by tying; or a pile strip can be adhered to the boot and a hook tab attached to the support strap.

As can be seen in the embodiments previously described, the support apparatus can easily be manufactured as a part of the ski suit. Or it can be attached to the suit either by the retailer or by the skier in various ways after the suit has been manufactured. A third alternative is to manufacture the support apparatus as part of long underwear pants so that it is attached to the long underwear instead of the ski suit and worn inside the ski suit. In some of the embodiments, the support apparatus can be attached to a belt to be worn by the skier instead of being attached to the waist of the apparel. If the support apparatus is not manufactured as a part of apparel, a strap adjuster such as that shown in FIG. 10 would be needed to fit the individual skier.

In some embodiments, especially those which are kept under tension, adding a strap which attaches around the support apparatus and around the thigh of the skier can keep the apparatus close to the body of the skier so the apparatus does not push out against the ski suit.

Such variations are not to be regarded as a departure from the spirit and scope of the invention and all such modifications as would be apparent to one skilled in the art should to be included within the scope of the following claims and their legal equivalents.

We claim:

1. Apparatus which can be worn by a person for supporting the weight of said person's legs, boots, skis and skiing apparatus, while said person is seated on a ski lift chair, comprising:

(a) at least one boot attachment means suitable for fastening to boot of said person, (b) at least one support member of elongated material having the pliability and flexibility of a cord of a predetermined length, capable of supporting said weight, said support member having a first end affixed to said boot attachment means and having a second end for extending adjacent and alongside said person's leg up to at least the back of said person's thigh area, (c) holding means for securing said support member to said person adjacent to said person's leg for keeping said support member close to said leg and for enabling a portion or said support member to extend up to at least behind a thigh of said person, (d) tensioning means for enabling said support member to be drawn taut from said first end up to at least said back or said person's thigh area against a front edge of a chair seat so as to support said weight, said tensioning means allowing said person's leg to be supported in a knee-bent position, and (e) locking means cooperating with said support member for enabling said support member to maintain said weight, whereby said apparatus can ease the strain and discomfort to said person's knees and legs when said person rides on a ski lift.

2. The apparatus of claim 1 wherein said boot attachment means comprises a strap capable of encircling an ankle part of said boot and including boot fastening means for attaching said strap to said boot.

3. The apparatus of claim 1 wherein said portion of said support member extending up to at least behind a thigh of said person has a higher coefficient of friction than the rest of said support member.

4. The apparatus of claim 3 wherein said higher coefficient of friction or said portion of said support member functions to create a frictional engagement between said thigh, said portion of said support member, and said chair seat when downward pressure of the thigh is placed on said portion.

5. The apparatus or claim 1 wherein at least a part of said support member is comprised of elastisized material.

6. The apparatus of claim 1 wherein said tensioning means comprises at least one spring-loaded reel attached to said support member, around which said support member can wind and unwind.

7. The apparatus of claim 6 wherein said locking means comprises a lock for engaging said reel, said lock being capable of holding said support member taut so as to maintain said weight.

8. The apparatus of claim 1 wherein said holding means comprises at least one spring-loaded reel, said reel being capable of keeping the length of said support member close to said leg.

9. The apparatus of claim 1 wherein said tensioning means comprises at least one elastic member, said elastic member being integrally attached at one end to said second end of said support member.

10. The apparatus of claim 1 wherein said locking means comprises a hook tab attached to said second end of said support member and at least one pile strip of a predetermined length, said pile strip capable of being attached to said apparel at or above the knee area of said parson.

11. The apparatus of claim 1 wherein said locking means comprises a frictional strap having one end integrally attached to said support member, said frictional strap being capable of supporting said weight when said person sits upon said frictional strap.

12. The apparatus of claim 11 wherein said tensioning means comprises at least one elasticized member, having an end integrally attached to said locking means and an other end attached to said boot attachment means, said elasticized member being capable of drawing said support member taut against said front edge of said chair seat.

13. The apparatus of claim 12, further including at least one strap attached to the back of the waist of said person's ski apparel and extending downward approximately to the bottom of said person's buttock area; and still further including guide means attached to said strap, said elasticized member being guided through said guide means.

14. The apparatus of claim 1 wherein said tensioning means comprises a pull tab attached to said second end of said support member capable of drawing taut said support member against said front edge when said pull tab is pulled by said person.

15. The apparatus of claim 1 wherein said portion of said support member extending up to at least behind a thigh of said person is capable of holding said weight when engaged by said person sitting upon said portion of said support member.

16. The apparatus of claim 1 wherein said holding means comprises a tube which encases at least a part of the length of said support member, said tube allowing said support member to slide within said tube.

17. The apparatus of claim 1, further including adjustment means in cooperative relationship with said support member, said adjustment means being capable of adjusting the length of said support member.

18. The apparatus of claim 1 wherein said support member is sized to extend up the inside of a pants leg of a predetermined length when worn by said person and exits to the outside of a pants through an opening in said pants situated at a point at least above the knee area.

19. The apparatus of claim 1 wherein said holding means comprises at least one loop capable of being attached to the back side of a pant apparel when worn by said person and around said support member.

20. The apparatus of claim 11 wherein said means for holding said support member comprises a spring-loaded reel attached to said boot attachment means and wherein said support member is fastened at said first end around said reel so as to be attached to said boot attachment means and so as to allow said support member to wind and unwind.

21. The apparatus of claim 1 wherein said support member is sized to extend up the outside of the back of a pant leg of a predetermined length when worn by said person.

22. The apparatus of claim 21 wherein said support member is secured to the back of the outside of a pant apparel when worn by said person.

23. The apparatus of claim 1 wherein said second end of said support member is attached to said locking mesas; said locking means comprising a frictional strap capable of holding the legs, boots, and skis of said person when engaged by said person sitting upon said frictional strap and which in turn is attached at one end to said tensioning means; and said tensioning means comprising at least one elastic member, said elastic member being capable of drawing taut said support member against said front edge of said chair seat.

24. The apparatus of claim 23 wherein said holding means comprises a tube within which said frictional strap and said elastic member is encased, said tube allowing said support member, said frictional strap, and said elastic member to move within said tube.

25. The apparatus of claim 1, further comprising a pair of pants wherein said support member is long enough to extend up the back of the inside a pant leg of a predetermined length when worn by said person to a point behind and below said person's knee and can exit said pant leg through a first opening in said pant leg and wherein said holding means comprises a tube affixed to the outside of said person's pant from a point below said first opening up to a point above the knee area in such a manner so as to serve as a channel for said support member through which said support member can slide, said support member continuing up the inside of said tube where said second end of said support member exits said tube.

26. The apparatus of claim 1 wherein said holding means secures said support member to ski apparel when worn by said person.

27. A method for supporting the weight of legs, boots, skis and skiing apparatus of a person while on a ski lift chair, comprising the steps of:

(a) providing said person with boot attachment means fastened to said person's boot, (b) providing said person with at least one support member of elongated material having the pliability and flexibility of a cord of a predetermined length capable of supporting said weight, said support member having one end fixed to said boot attachment means and having a second end for extending adjacent and alongside said person's leg to at least the back of said person's thigh area, (c) providing a holding means for securing said support member to said person adjacent to said person's leg, said holding means functioning to keep said support member close to said leg and allowing for placement of a portion of said support member behind said person's thigh area when utilizing said method, (d) utilizing a tensioning means to draw taut said support member from said first end up to at least said back of said person's thigh against a front edge of a chair seat so as to carry said weight, allowing said person's leg to be supported in a knee-bent position, and (e) engaging a locking means cooperating with said support member, enabling said support member to maintain said weight, whereby utilizing said method can ease the strain and discomfort to said person's knees when said person rides on a ski lift.

28. The method of claim 27 wherein said engaging a locking means comprises the step of placing the downward pressure of said thigh upon said portion of said support member.

29. The method of claim 27 wherein said utilizing a tensioning means comprises the step of pulling on said second end of said support member.

* * * * *